US006257793B1

(12) United States Patent
Lin

(10) Patent No.: US 6,257,793 B1
(45) Date of Patent: Jul. 10, 2001

(54) JOINT SOCKET STRUCTURE USED IN ARTIFICIAL CHRISTMAS TREES

(76) Inventor: Fong Shi Lin, No. 196, Chin Long Road, Hsio Chin Ko Chang, Hwei Chou City, Kaun Ton (CN)

( * ) Notice: Subject to any disclaimer, the term of this patent is extended or adjusted under 35 U.S.C. 154(b) by 0 days.

(21) Appl. No.: 09/388,621

(22) Filed: Sep. 2, 1999

(51) Int. Cl.[7] ..... F16B 11/00; F16D 1/00; F16D 3/84; F16L 11/12

(52) U.S. Cl. ..... 403/23; 403/14; 403/152; 428/9

(58) Field of Search ..... D11/118; 403/14, 403/24, 25, 150, 152, 157, 164, 23; 428/9, 12, 18; 16/250

(56) References Cited

U.S. PATENT DOCUMENTS 3,350,750 * 11/1967 Scarr et al. ..... 24/126
3,616,107 * 10/1971 Kershner ..... 161/24
3,728,202 * 4/1973 Baus et al. ..... 161/24
3,928,689 * 12/1975 Mottel ..... 428/9
4,109,345 * 8/1978 Sargent et al. ..... 16/149
4,140,823 * 2/1979 Weskamp ..... 428/19
4,496,615 * 1/1985 Huang ..... 428/9
4,640,642 * 2/1987 Magid et al. ..... 403/157
4,659,597 * 4/1987 Lau ..... 428/9
4,795,288 * 1/1989 Sakai ..... 403/24
4,847,123 * 7/1989 Armstead et al. ..... 428/9
5,342,661 * 8/1994 Wilcox, II ..... 428/18
5,536,538 * 7/1996 Hartung ..... 428/12

* cited by examiner

*Primary Examiner*—Lynne H. Browne
*Assistant Examiner*—John B. Walsh
(74) *Attorney, Agent, or Firm*—Rosenberg, Klein & Lee

(57) ABSTRACT

An improved joint socket structure used in artificial Christmas trees has enhanced safety, avoiding electrical wires from being squeezed and damaged by rotary branches. The main improvement is an arcuate shield disposed on each pivotal joint socket that connects the branches to the main trunk. The shield covers the space above the joint socket so that electrical wires wound around the Christmas trees will not get into the movement space of rotary branches. By way of this, the joint socket structure according to the invention can prevent electrical current leakage and electrical shocks caused by broken electrical wires.

3 Claims, 6 Drawing Sheets

JOINT SOCKET STRUCTURE USED IN ARTIFICIAL CHRISTMAS TREES

BACKGROUND OF THE INVENTION

The invention aims at the improvements of a prior art artificial Christmas tree structure that has such rotary branches that can be folded into a compact form. FIGS. 1 and 2 show the configuration of such an artificial Christmas tree. As can be seen from the drawings, an artificial Christmas tree includes a main trunk (10) with a plurality of pivotal joint socket (30), to each of which a branch (20) is attached. Each branch is provided with twigs (22) and needles. The rotary joint socket (30) has such means that allows branches (20) to be attached at a preset inclination and extends outwardly to display a form of Christmas tree. The branch (20) can be rotated around the pivotal joint socket (30) to close to the trunk (10) so that the artificial Christmas tree can be wrapped for further carrying or storage. Although the artificial Christmas tree structure provides convenience for delivery and storage, it still has a potential risk of electrical leakage. The cause consists in the pivotal joint structure. After the joint socket (30) is connected with a branch (20), the space (301) near the pivotal end of the branch is accessible from the outside. Electrical wires (60) wound around the artificial Christmas tree along with miniature light bulbs might drop into the open space (301), as a result of which when branches are stretched outwardly again electrical wires as well as light bulbs might be clamped and damaged by moving branches and pivotal joint socket (30). Because that an artificial Christmas tree must be able to provide enough strength to support the entire weight, the trunk (10) and branches (20) and the pivotal joint sockets (30) usually are made of metal materials. Thus if a branch (20) and a pivotal joint socket (30) clamp electrical wires therebetween, then the weight of a branch associated with twigs and needles will exert a great clamping force on the electrical wires (60). This may injure the sheath of electrical wires and leads to electrical leakage. Therefore such artificial Christmas tree structure is not satisfactory in safety. To solve the problem, the inventor has endeavored to overcome the above deficiency for a long time and finally worked out an improved Christmas tree structure. According to the invention, a shield (40) that can move along with the rotary motion of branches (20) is disposed on each pivotal joint socket to cover the space (301) above the socket to protect electrical wires from dropping into the rotary space and being clamped by rotary branches. Thus the structure according to the invention can eliminate the possibility of electrical leakage due to electrical wires clamped in a pivotal joint socket.

Now the structural features and advantages of the invention will be further described in detail with reference to the accompanying drawings.

BRIEF DESCRIPTION OF THE ACCOMPANYING DRAWINGS

DETAILED DESCRIPTION OF PREFERRED EMBODIMENTS

Figure 1:
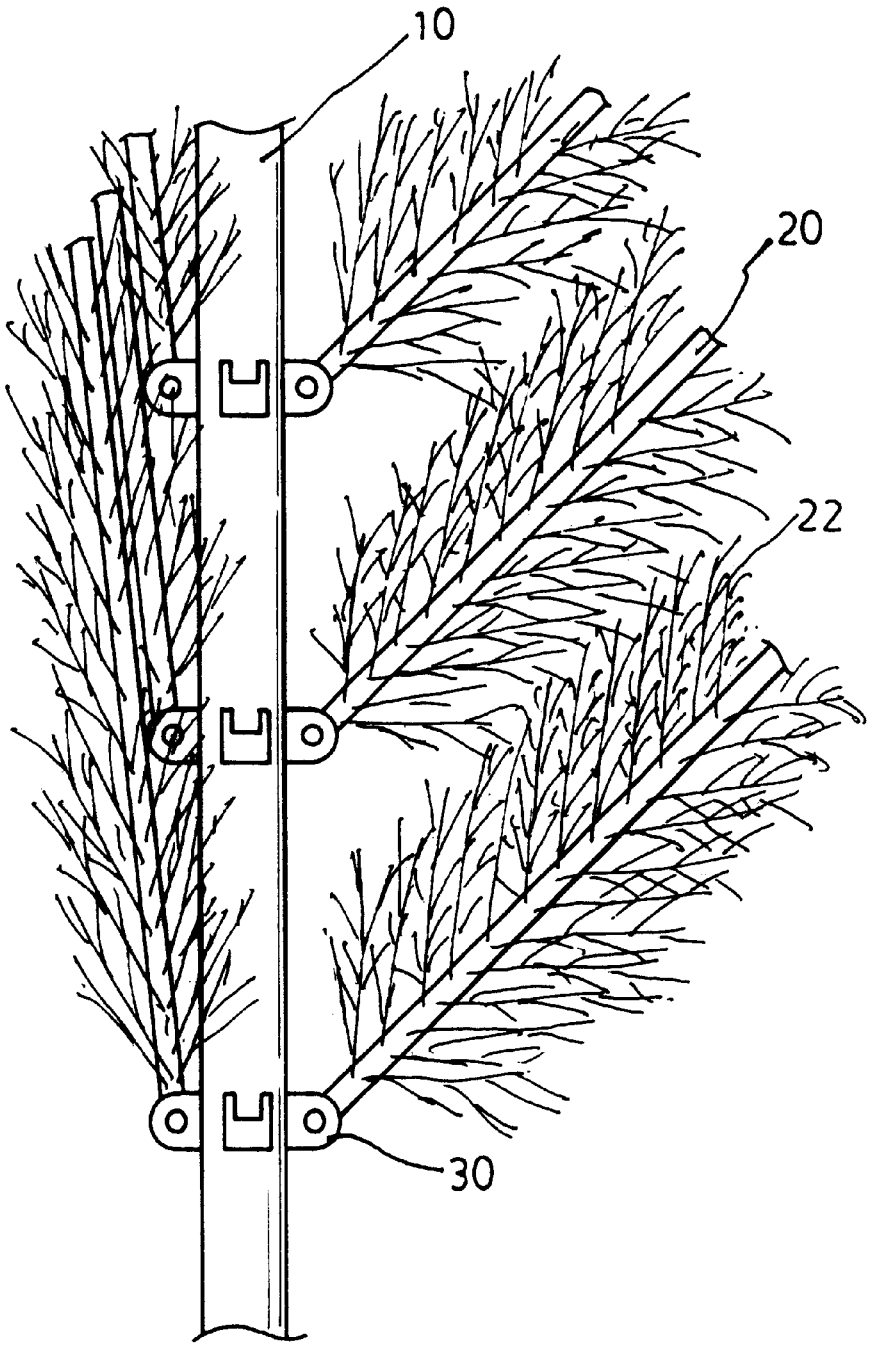
FIG. 1 is a plan view schematically showing an artificial Christmas tree structure.
Figure 2:
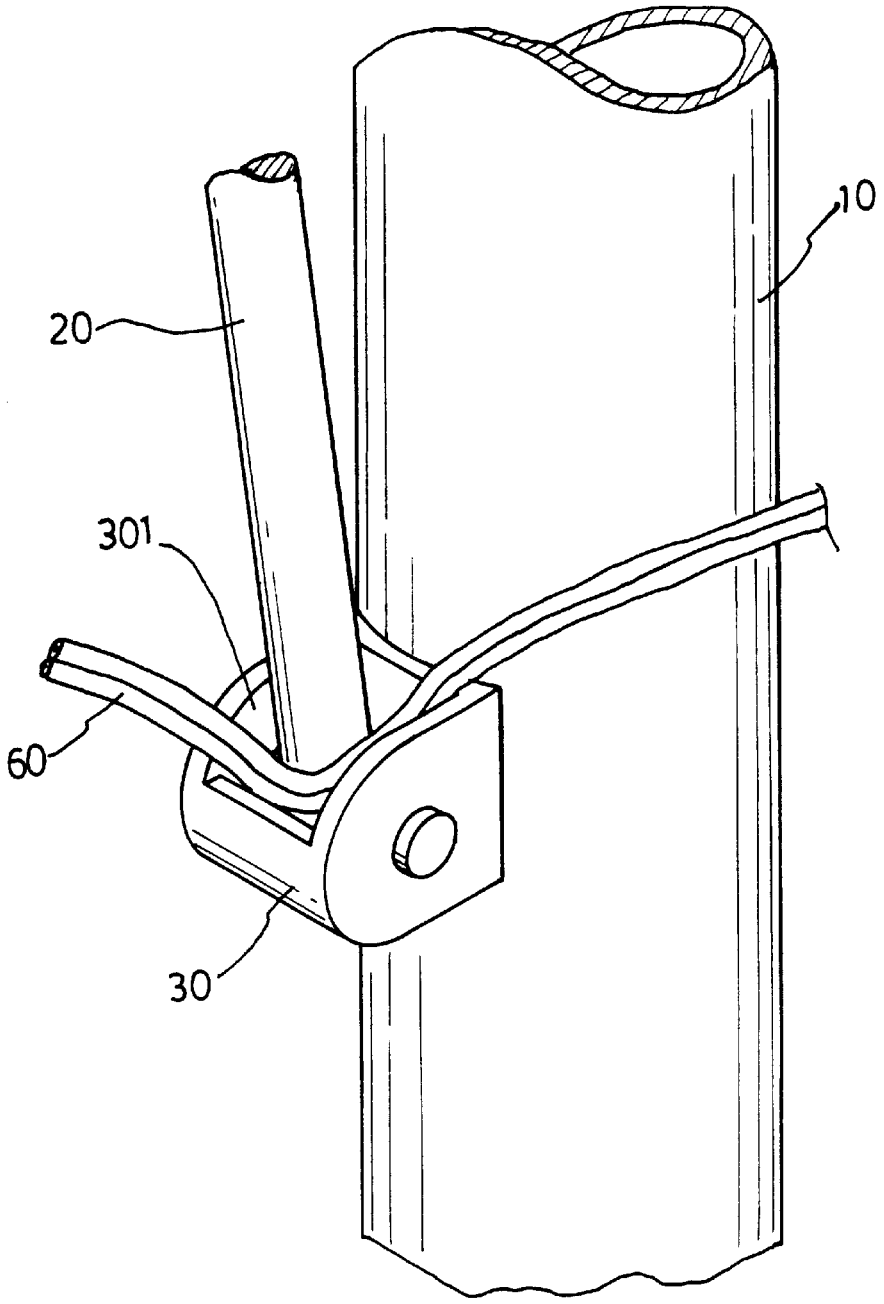
FIG. 2 (prior art)
FIG. 2 shows a pivotal joint socket according to the prior art.
Figure 3:
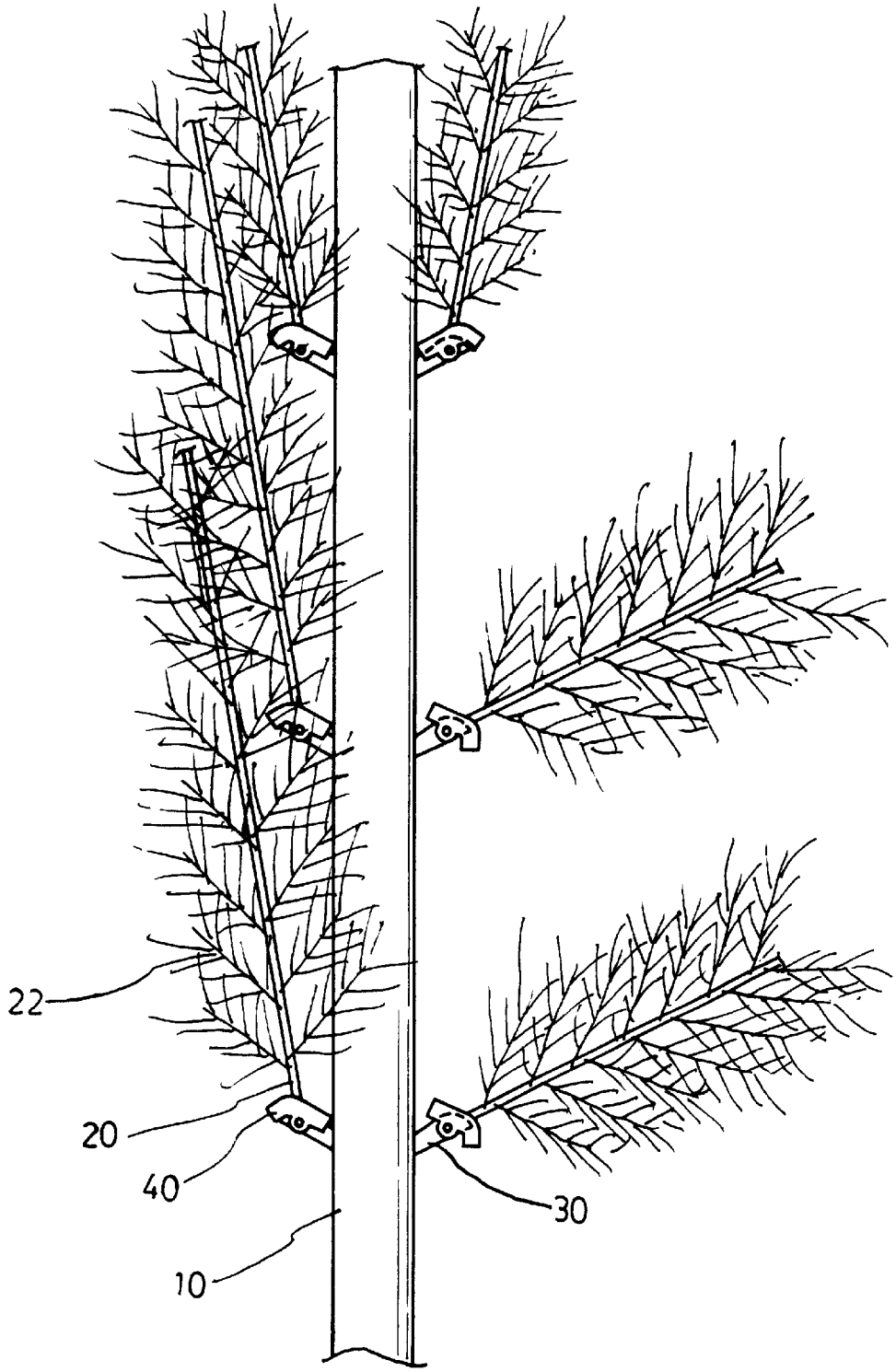
FIG. 3 is a perspective view schematically showing an artificial Christmas tree structure according to this invention.
Figure 4:
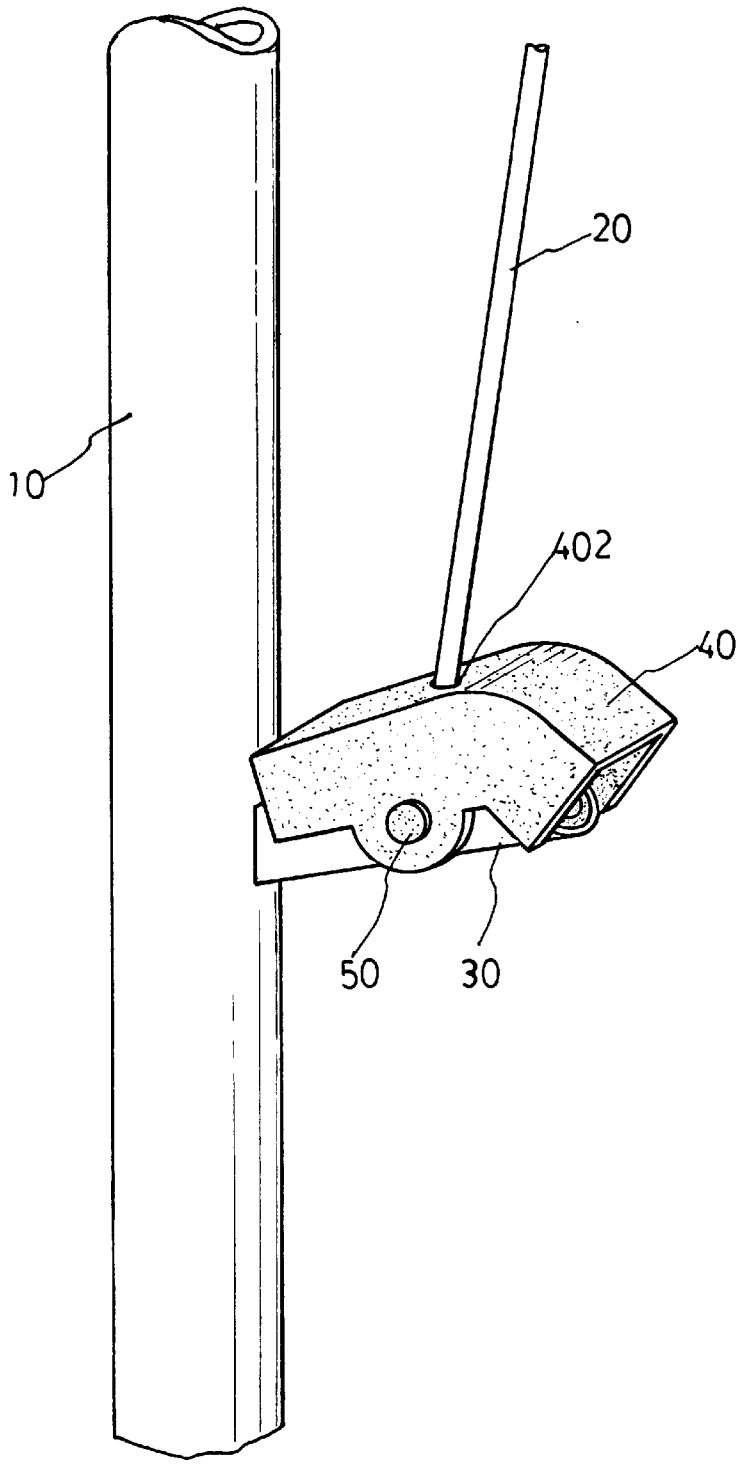
FIG. 4 illustrates an improved pivotal joint socket according to the present invention.
Figure 5:
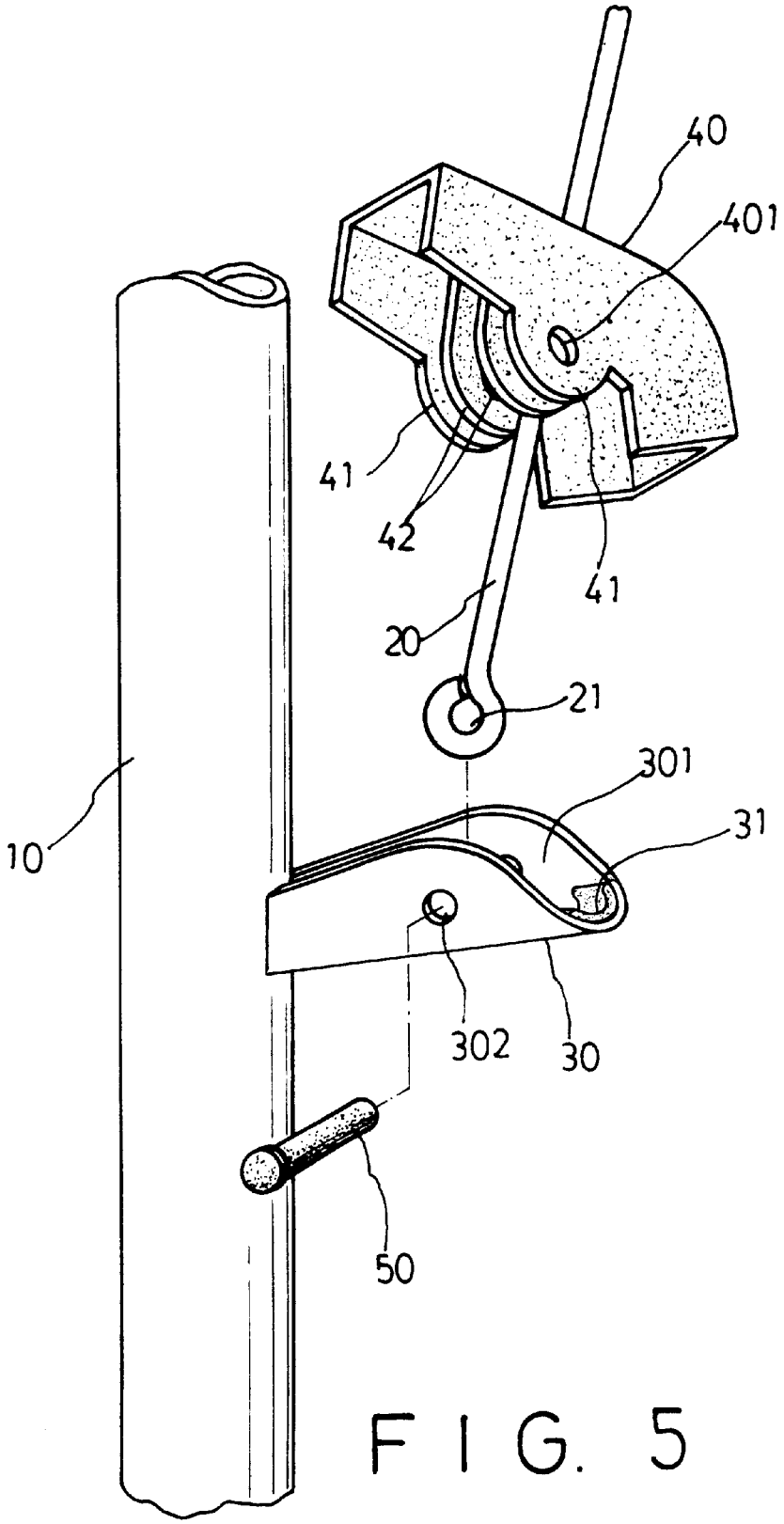
FIG. 5 is an exploded view of the pivotal joint socket of FIG. 4.
Figure 6:
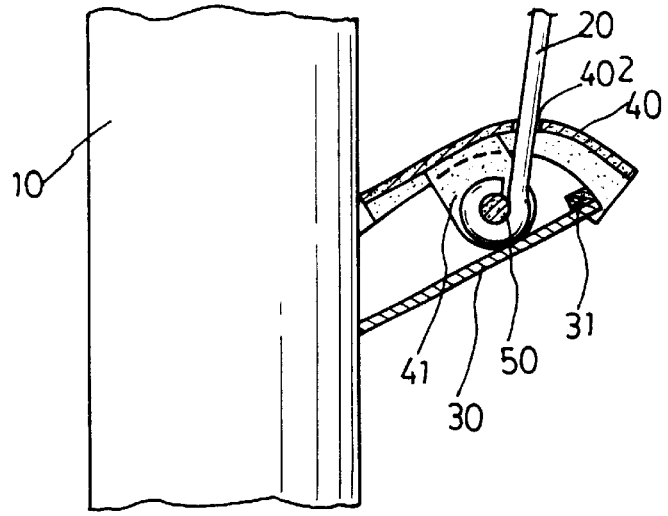
FIGS. 6 and 7 are the side views of the pivotal joint socket of FIG. 4 illustrating the movement of a rotary branch in the socket.
Figure 8:
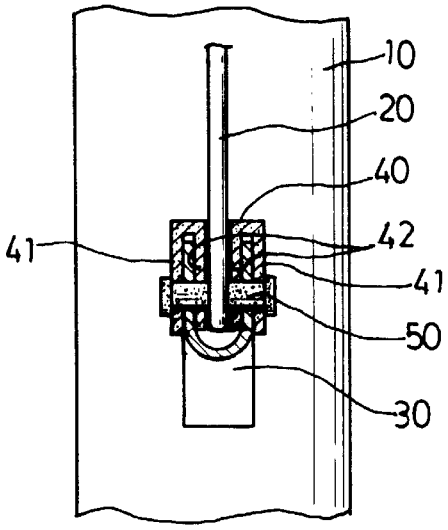
FIG. 8 is a front view of the pivotal joint socket of FIG. 4.
Figure 7:
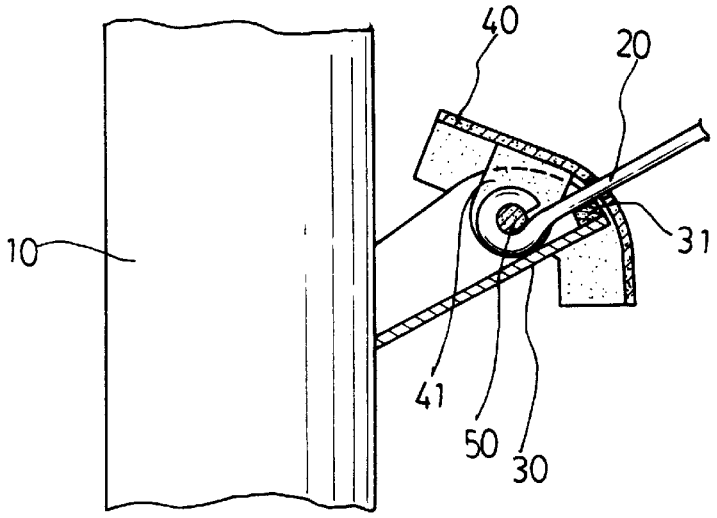

With reference to FIGS. 3 to 8, a pivotal joint socket (30) according to invention is fixedly disposed on the main trunk (10) of an artificial Christmas tree. The rotary joint socket (30) being U-shaped is provided with hole (302) on both sides and is provided with a soft buffer (31) at bottom side. A shield (40) being made of insulted material is formed thereon. The shield (40) has its two bottom sides being rotary plate (41) and a pair of connecting plates (42) is formed therein. Each-space width between the plates (41), (42) is slightly larger than the thick of the socket (30). The rotary plates (41) and the connecting plates (42) are provided with the same axial hole (401). A circular hole (402) is formed on the top of shield (40) for connecting the branch (20), which has an end connecting hole (31). Such that, the shield (40) and the branches (20) are capable of placing on the joint socket (30) and both sides of the socket (30) are placed between the spaces of the plates (41) of the shield (40) and the connecting plates (42), as shown in FIG. 8. An insulated shaft (50) is inserted in the hole (302) of the socket (30), the connecting hole (21) of the branch (20), and the hole (401) of the shield (40). So the branch (20) and the shield (40) are connected rotary with the socket (30), as shown in FIGS. 6 and 7. Therefore, the shield (40) and the branch (20) can be rotary at the same time. When the branch (20) is closed, as in FIG. 6, the space (301) of the joint socket (30) is shielded by the shield (40). This structure can prevent the electrical wires from falling into the space (301) of the socket (30) and avoiding the branch (20) clamping the wires when being rotary. Moreover, because the buffer (31), shield (40), and the shaft (50) are made of insulated materials, they separates the metal main trunk (10), branch (20), and the joint socket (30) to become insulation, that prevent from electrical leakage for safe use if the electrical wires are accidentally broken.

What is claimed is:

1. A collapsible artificial Christmas tree comprising:

(a) a trunk;

(b) a plurality of branches disposed to extend therefrom, each said branch having formed at a terminal end thereof an end connecting hole; and, (c) a joint socket assembly for pivotally coupling one said branch to said trunk, said joint socket assembly including:

(1) a rotary joint socket fixedly coupled to said trunk and having a free end radially offset therefrom, said rotary joint socket having a substantially U-shaped portion defining a space between a pair of laterally opposed side surfaces, each of said side surfaces having formed therein a hole communicating with said space;

(2) an electrically insulated shield coupled in pivotally displaceable manner to said rotary joint socket, said shield having an upper portion and a pair of laterally spaced rotary plate portions extending therefrom, said shield having a pair of laterally spaced connecting plate portions extending from said upper portion between said rotary plate portions, adjacent ones of said rotary and connecting plate portions receiving one said rotary joint socket side surface therebetween, each said rotary and connecting plate portion having formed therethrough an axial hole substantially aligned with said side surface holes of said rotary joint socket, said upper portion having a top hole receiving one said branch therethrough;

(3) an electrically insulated shaft passing through said side surface holes of said rotary joint socket, said rotary and connecting plate portion axial holes of said shield, and said end connecting hole of said branch to pivotally couple said rotary joint socket, shield and branch;

said shield and said branch together being thereby pivotally displaceable about said shaft between collapsed and extended positions, said shield in both said collapsed and extended positions covering said free end of said rotary joint socket for preventing the capture of an article thereagainst.

2. The collapsible artificial Christmas tree as recited in claim 1 wherein of said joint socket assembly further includes an electrically insulated buffer coupled to said rotary joint socket for supporting said branch in said extended position thereof.

3. The collapsible artificial Christmas tree as recited in claim 1 wherein said shield and shaft are each integrally formed of an electrically insulating material.

* * * * *